US011346633B1

(12) United States Patent
Kurtyka et al.

(10) Patent No.: US 11,346,633 B1
(45) Date of Patent: May 31, 2022

(54) RELEASE HOLSTER APPARATUS AND METHOD

(71) Applicants: Jonathan R. Kurtyka, Tijeras, NM (US); Sandra Kulina, Neshanic Station, NJ (US)

(72) Inventors: Jonathan R. Kurtyka, Tijeras, NM (US); Sandra Kulina, Neshanic Station, NJ (US)

( * ) Notice: Subject to any disclaimer, the term of this patent is extended or adjusted under 35 U.S.C. 154(b) by 0 days.

(21) Appl. No.: 17/696,516

(22) Filed: Mar. 16, 2022

(51) Int. Cl.
*F41B 5/18* (2006.01)
*F41B 5/14* (2006.01)

(52) U.S. Cl.
CPC ..... *F41B 5/148* (2013.01); *F41B 5/1469* (2013.01)

(58) Field of Classification Search
CPC . F41B 5/1469; F41B 5/1473; A45C 2013/303
See application file for complete search history.

(56) References Cited

U.S. PATENT DOCUMENTS 6,125,833 A * 10/2000 Tentler ..... F41B 5/1469 124/35.2
6,481,431 B1 * 11/2002 Summers ..... F41B 5/1469 124/35.2
7,644,709 B2 * 1/2010 Tilby ..... F41B 5/1469 124/35.2
7,753,043 B1 * 7/2010 Eckert ..... F41B 5/1469 124/35.2
7,926,476 B1 * 4/2011 Tentler ..... F41B 5/1469 124/35.2
8,061,340 B2 * 11/2011 Mitchell ..... F41B 5/1469 124/35.2
8,746,223 B2 * 6/2014 Jones ..... F41B 5/1469 124/35.2
9,255,761 B2 * 2/2016 Rentz ..... F41B 5/1469
11,125,526 B2 * 9/2021 Jezwinski ..... F41B 5/1469

OTHER PUBLICATIONS https://www.etsy.com/shop/AJBHolsters?ref=usf_2020; link provided Mar. 14, 2022, downloaded link information on Mar. 16, 2022.

* cited by examiner

*Primary Examiner* — John A Ricci
(74) *Attorney, Agent, or Firm* — Walter J. Tencza, Jr.

(57) ABSTRACT

An apparatus having a release holster apparatus including: an elongated strap; a pocket between first and second sections of cloth material, attached to the elongated strap; and a flap attached to the elongated strap; wherein the pocket has top and bottom openings; wherein the flap has a first end attached nearer the top than the bottom opening: wherein the flap has a second end opposing the first end of the flap; wherein the flap in an open state does not cover any part of the top opening of the pocket; and wherein the flap is configured to be placed in a closed state in which the flap covers part, but not the entirety of the top opening of the pocket, and wherein a section of the flap is attached to a portion of the first section of cloth material of the pocket.

12 Claims, 9 Drawing Sheets

RELEASE HOLSTER APPARATUS AND METHOD

FIELD OF THE INVENTION

This invention relates apparatuses and methods for holding archery equipment.

BACKGROUND OF THE INVENTION

Hand-held archery release aids are known in the art. Hand-held archery release aids are configured in order to allow an archer to attach a mechanical release aid to a string or d-loop of a bowstring as a function of assistance in (a) drawing back the bowstring prior to shooting, and (b) to facilitate and improve the consistency of the physical mechanics of the archer related to executing the shot. Previously, the most popular forms of release aids were characterized by a trigger-style activation mechanism attached directly to a wrist strap. However, over the last five years the hand-held style of release aid has become increasingly popular. While the hand-held archery release is often credited with gains in archery accuracy over more traditional trigger-style release aids, hand-held archery releases generally lack an effective way of managing the release when it is not in use by the archer.

A hardened plastic holster, which is not universal, but rather is configured to hold only individual, specific types of release aids, is known in the art. This known holster is manufactured out of a hardened plastic, that is molded to the hand-held archery release and then secured with a clip to some aspect of the archer's body or other equipment.

SUMMARY OF THE INVENTION

In at least one embodiment a release holster apparatus is provided, which is a unique, wearable device, designed specifically for the archery industry, to carry a hand-held archery release aid safely on one's wrist, while offering a method by which to deploy it quickly for use. The release holster apparatus is typically attached to the wrist, with near universal application to the many, and highly varied types of commercially available hand-held archery releases.

In at least one embodiment the release holster apparatus is configured as a stand-alone form of wearable storage specifically for a hand-held archery release aid that remains attached to the wrist by means of its integrated wrist strap and requires no additional point of attachment (e.g., pockets, bags, clips, belts, satchels, other binding materials, etc.). The pocket of the release holster apparatus in at least one embodiment is designed specifically to address the unique shape and style of the widest variety of hand-held archery release aids possible. The bottom of the pocket is an open design allowing longer hand-held archery release aids to protrude unimpeded, while the top of the release holster apparatus's pocket is configured with a magnetic closure to ensure both smooth and silent operation of a retention flap. The retention flap itself is off set to accommodate the activation barrel of most hand-held archery release aids.

The dimension of the pocket of the release holster apparatus is sized in at least one embodiment, to allow for smooth, convenient entry and egress of the hand-held archery release aid using one hand. In order to accommodate the disproportionate size of most hand-held archery release aids, the top of the pocket incorporates reinforced bolstering to maintain the form of the mouth of the pocket even while under tension by the wrist strap. In at least one embodiment, the interior of the pocket incorporates an integrated D-ring retention point to allow for optional attachment of the hand-held archery release aid to the release holster apparatus. The wrist strap itself typically uses hook-and-loop material to adjust in size, and is integrated into the pocket with a streamlined, minimalist configuration that encourages weight savings while maintaining adequate resistance to twisting and sliding.

In at least one embodiment, an apparatus is provided comprising: a release holster apparatus including: an elongated strap; a pocket formed between first and second sections of cloth material, and attached to the elongated strap; and a flap attached to the elongated strap; wherein the pocket has a top opening and an opposing bottom opening; wherein the flap has a first end attached nearer to the top opening of the pocket than the bottom opening of the pocket; wherein the flap has a second end which opposes the first end of the flap; wherein the flap is configured to be placed in an open state in which the flap does not cover any part of the top opening of the pocket; and wherein the flap is configured to be placed in a closed state in which the flap covers part of the top opening of the pocket, but not the entirety of the top opening of the pocket, and wherein a section of the flap is attached to a portion of the first section of material of the pocket.

In at least one embodiment, the apparatus further includes a hand-held archery release aid configured to fit at least partially in the pocket.

In at least one embodiment, the first section of cloth material of the pocket is attached to the flap through a magnetic connection.

The elongated strap may have first and second ends; wherein the apparatus includes a first attachment device located nearer to the first end of the elongated strap than the second end of the elongated strap; wherein the apparatus includes a second attachment device located nearer to the second end of the elongated strap than the first end of the elongated strap; wherein the elongated strap is configured to wrap around a person's wrist with the first attachment device detachably attached to the second attachment device in order to hold the elongated strap, the pocket, the flap, and/or the hand-held archery release aid onto the person's wrist.

The pocket is typically configured to hold hand-held archery release aids of different sizes. In at least one configured as previously described.

The method may further include placing the flap in an open state in which the flap does not cover any part of the top opening of the pocket; and placing the flap in a closed state in which a section of the flap is attached to a portion of the first section of cloth material of the pocket to thereby cover part of the top opening of the pocket, but not the entirety of the top opening of the pocket.

The method may further include inserting a hand-held archery release aid at least partially into the pocket when the flap is in an open state.

The first section of cloth material of the pocket may be attached to the section of the flap through a magnetic connection.

The method may further include wrapping the elongated strap around the person's wrist with the first attachment device detachably attached to the second attachment device in order to attach the elongated strap, the pocket, the flap and/or the hand-held archery release aid onto the person's wrist.

DETAILED DESCRIPTION OF THE DRAWINGS

Figure 1:
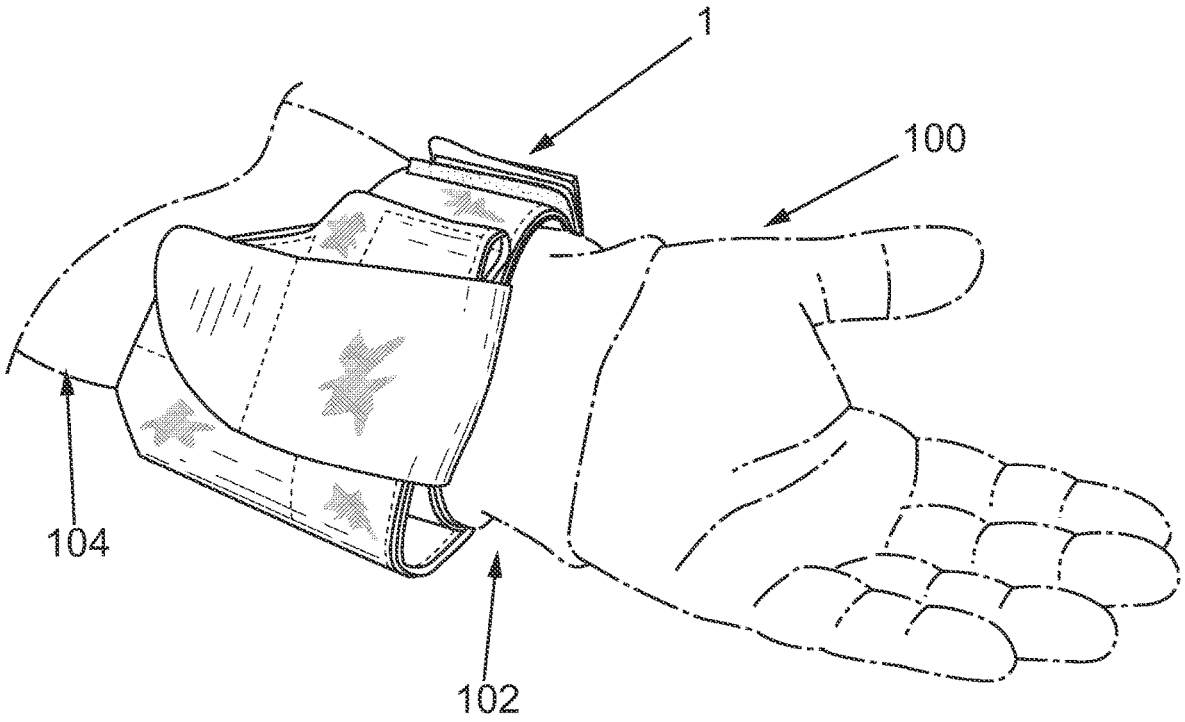
FIG. 1 is a perspective view of a release holster apparatus in accordance with an embodiment of the present invention in a closed state wrapped around a wrist of a person, wherein the person's wrist, arm, and hand shown in broken lines.

FIG. 1 is a perspective view of a release holster apparatus 1 in accordance with an embodiment of the present invention in a closed state wrapped around a wrist 102 of a person, wherein the person's wrist 102, arm 104, and hand 100 shown in broken lines.

Figure 2:
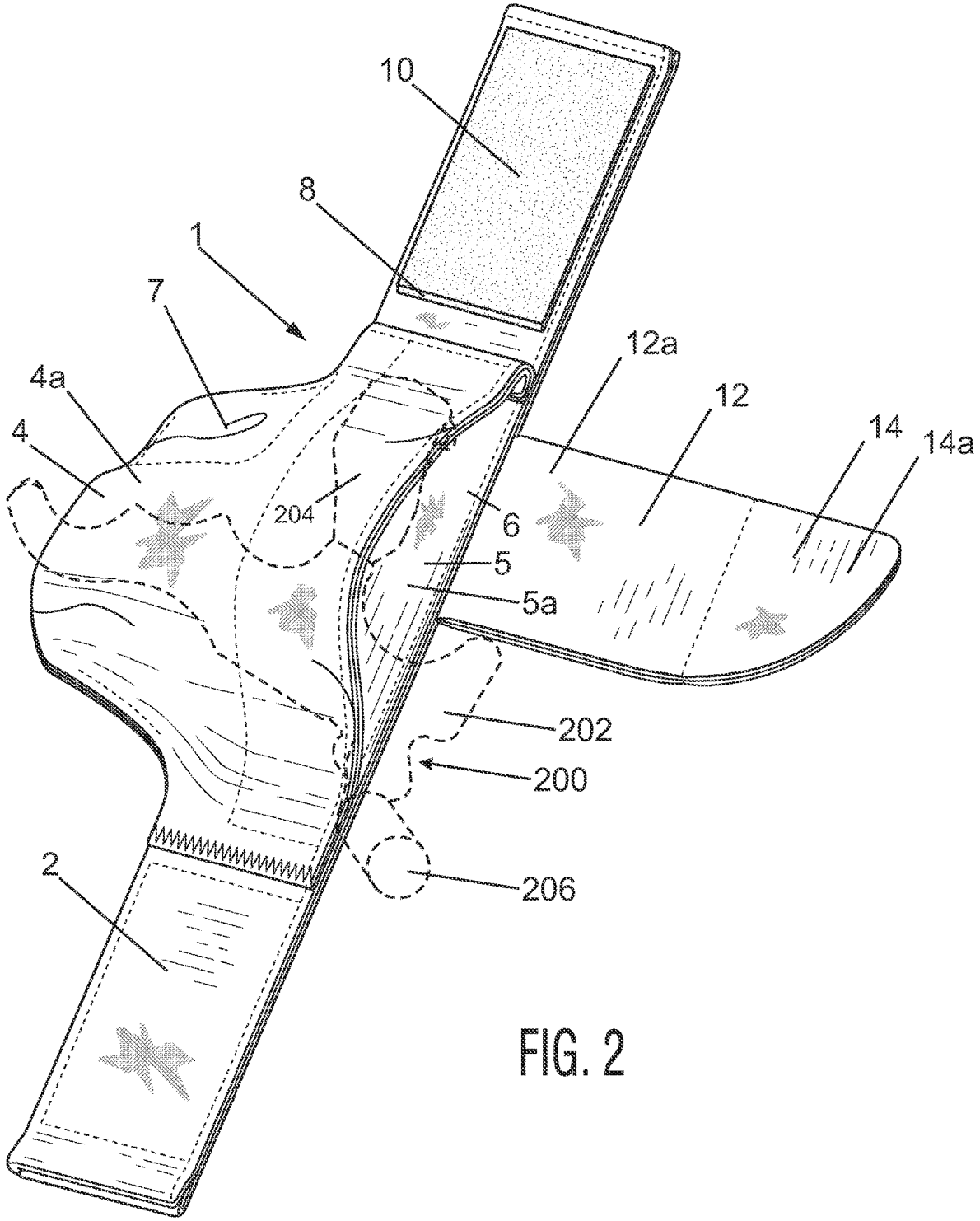
FIG. 2 is a front, top, and right perspective view of the release holster apparatus of FIG. 1 in a first open state, with a flap not attached to a central section; and a perspective view of a simplified diagram shown in dashed lines of a known hand-held archery release aid at least partially inside of a pocket of the release holster apparatus of FIG. 1.

FIG. 2 is a front, top, and right perspective view of the release holster apparatus 1 of FIG. 1 in a first open state, with a flap (including sections 12 and 14) not attached to a central section 4; and a perspective view of a simplified diagram shown in dashed lines of a known hand-held archery release aid 200 at least partially inside of a pocket 5 of the release holster apparatus 1. In FIG. 2, at least part of the archery release aid 200 is within the pocket 5, between the sections 4 and 6, but is shown, as if the section 4 were transparent, for explanation purposes. However, typically section 4, would not be transparent, and would block a substantial portion of the release aid 200 from being seen in the view of FIG. 2.

Figure 3:
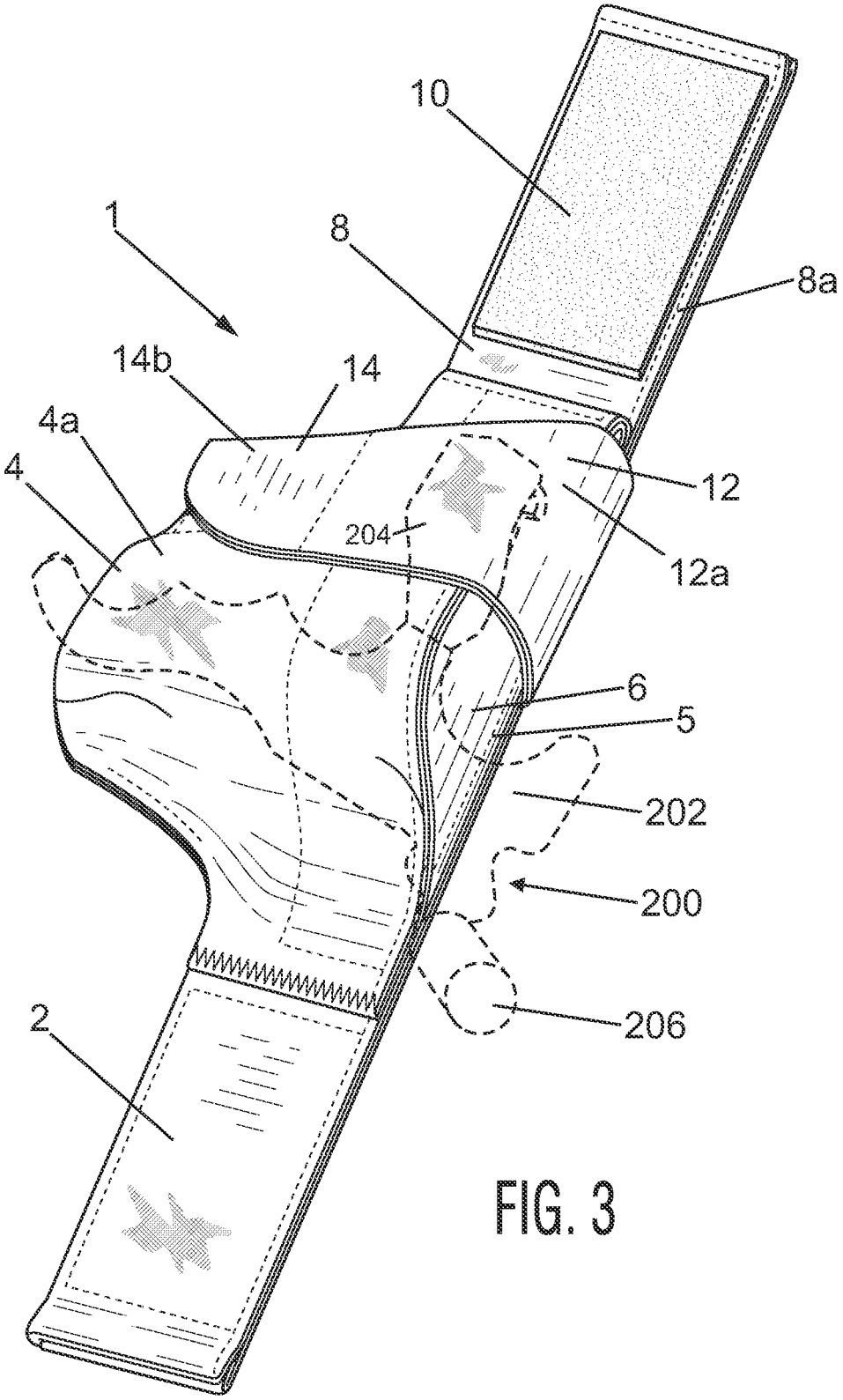
FIG. 3 is a front, top, and right perspective view of the release holster apparatus of FIG. 1 in a second open state, with the flap attached to the central section; and a perspective view of a simplified diagram shown in dashed lines of a known hand-held archery release aid at least partially inside of the pocket of the release holster apparatus of FIG. 1.

FIG. 3 is a front, top, and right perspective view of the release holster apparatus 1 of FIG. 1 in a second open state, with the flap (including sections 12 and 14) attached to the central section 4; and a perspective view of a simplified diagram shown in dashed lines of the known hand-held archery release aid 200 inside of the pocket 5 of the release holster apparatus 1. In FIG. 3, at least part of the archery release aid 200 is within the pocket 5, between the sections 4 and 6, but is shown, as if the sections 4 and the flap (sections 14 and 12) were transparent, for explanation purposes. However, typically section 4 and the flap (sections 4 and 12), would not be transparent, and would block a substantial portion of the release aid 200 from being seen in the view of FIG. 3.

Figure 4:
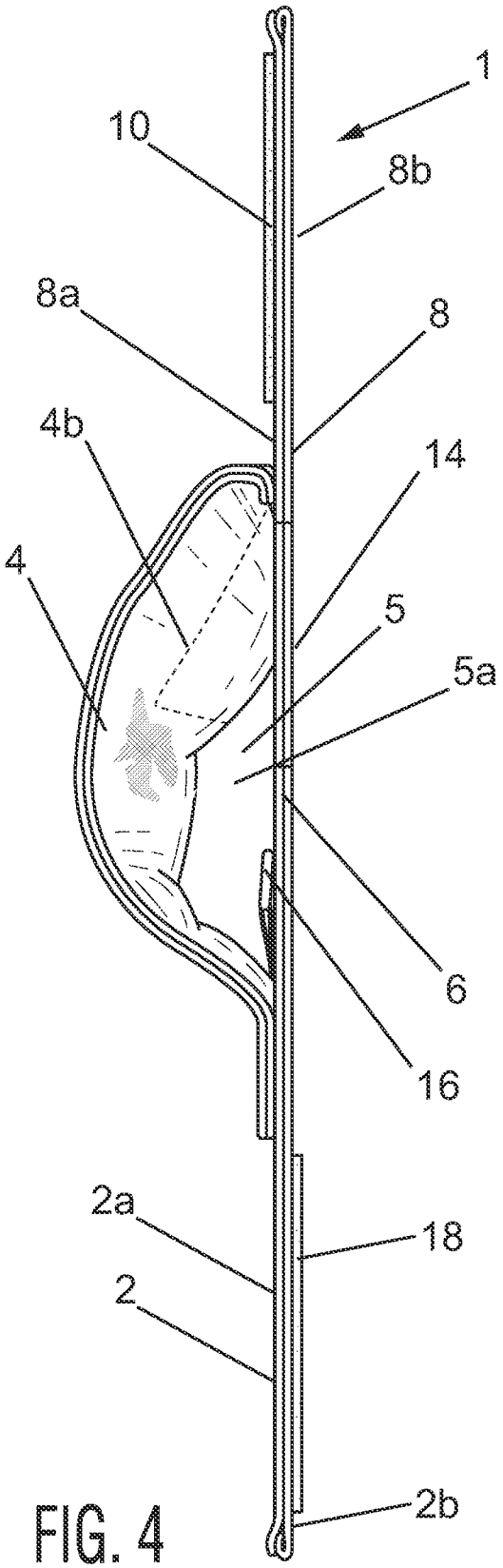
FIG. 4 is a right side elevational view of the release holster apparatus of FIG. 1 in the first open state of FIG. 2.

FIG. 4 is a right side elevational view of the release holster apparatus 1 of FIG. 1 in the first open state of FIG. 2.

Figure 5:
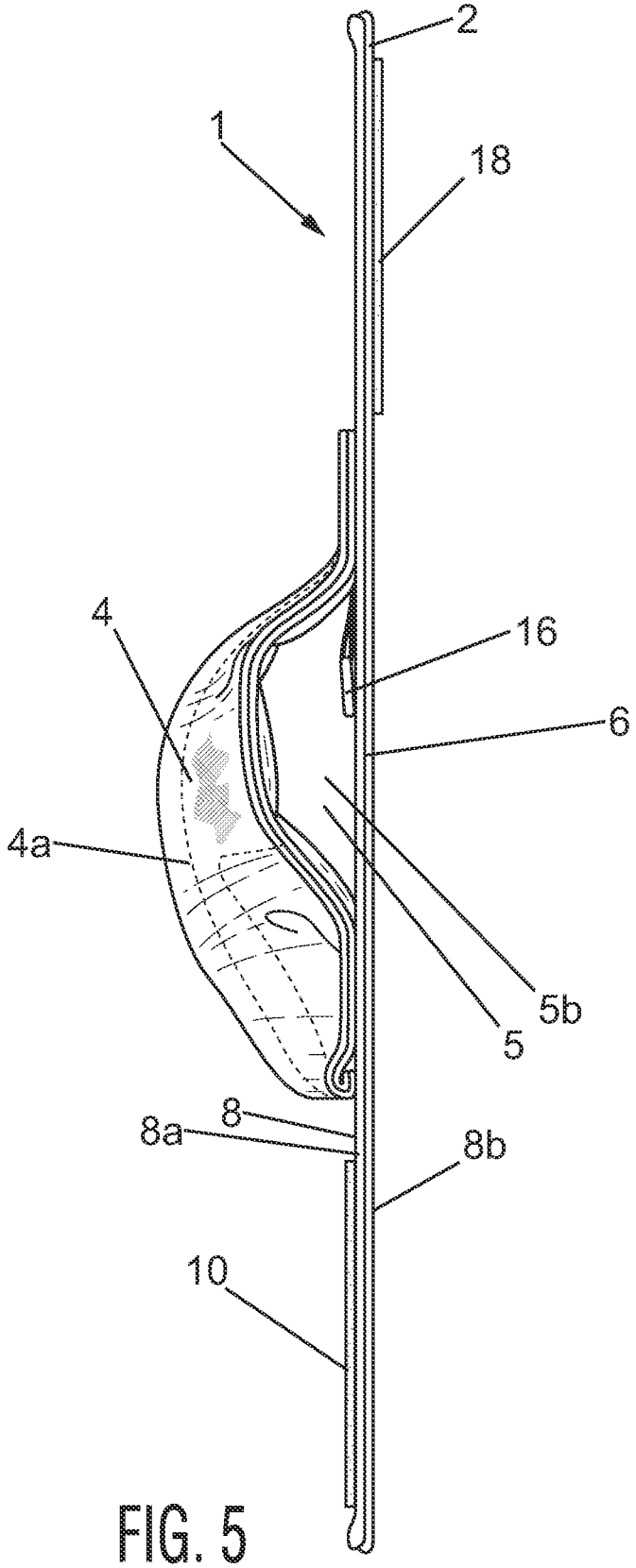
FIG. 5 is a left side elevational view of the release holster apparatus of FIG. 1 in the first open state of FIG. 2.

FIG. 5 is a left side elevational view of the release holster apparatus 1 of FIG. 1 in the first open state of FIG. 2.

Figure 6:
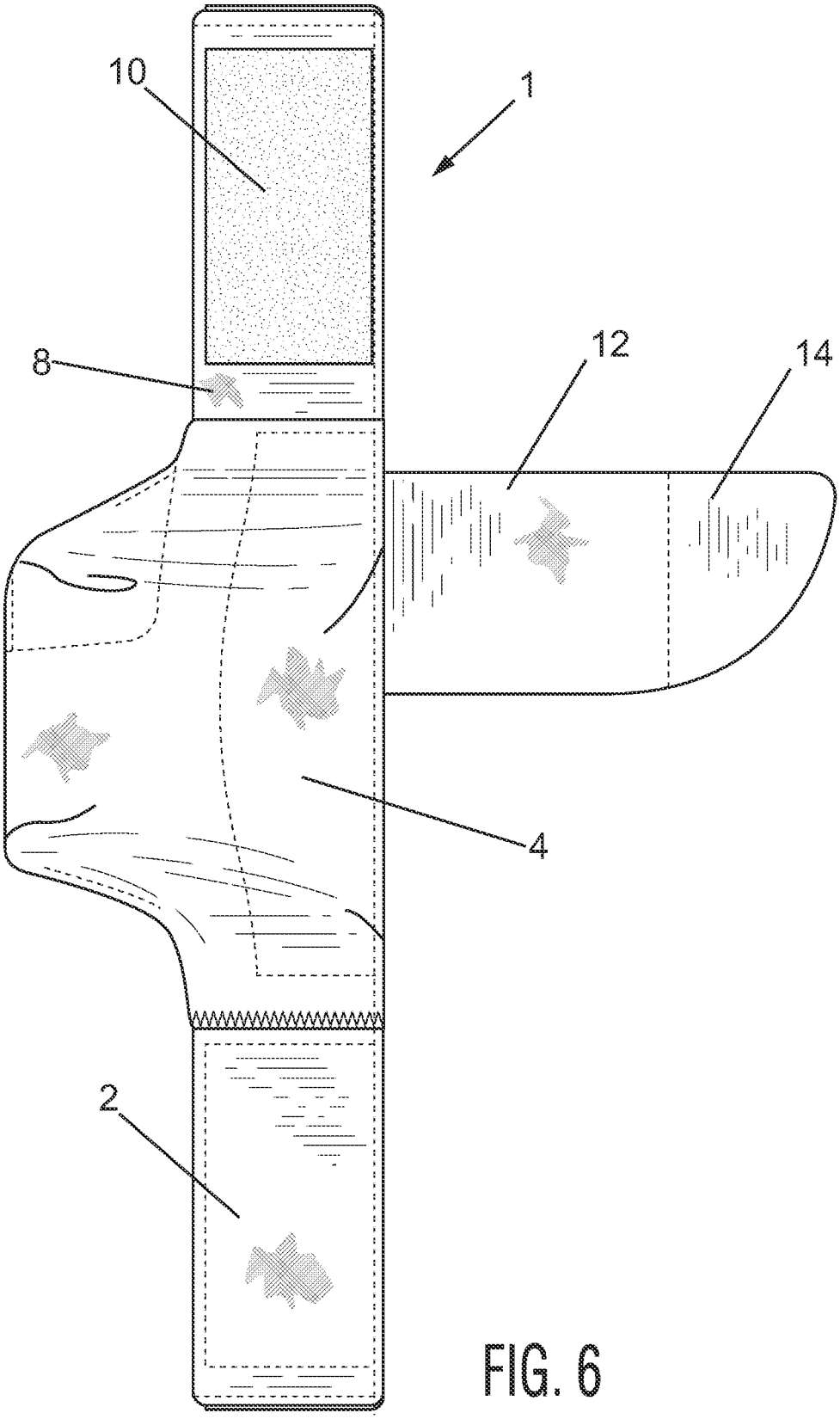
FIG. 6 is a top elevational view of the release holster apparatus of FIG. 1 in the first open state of FIG. 2.

FIG. 6 is a top elevational view of the release holster apparatus 1 of FIG. 1 in the first open state of FIG. 2.

Figure 7:
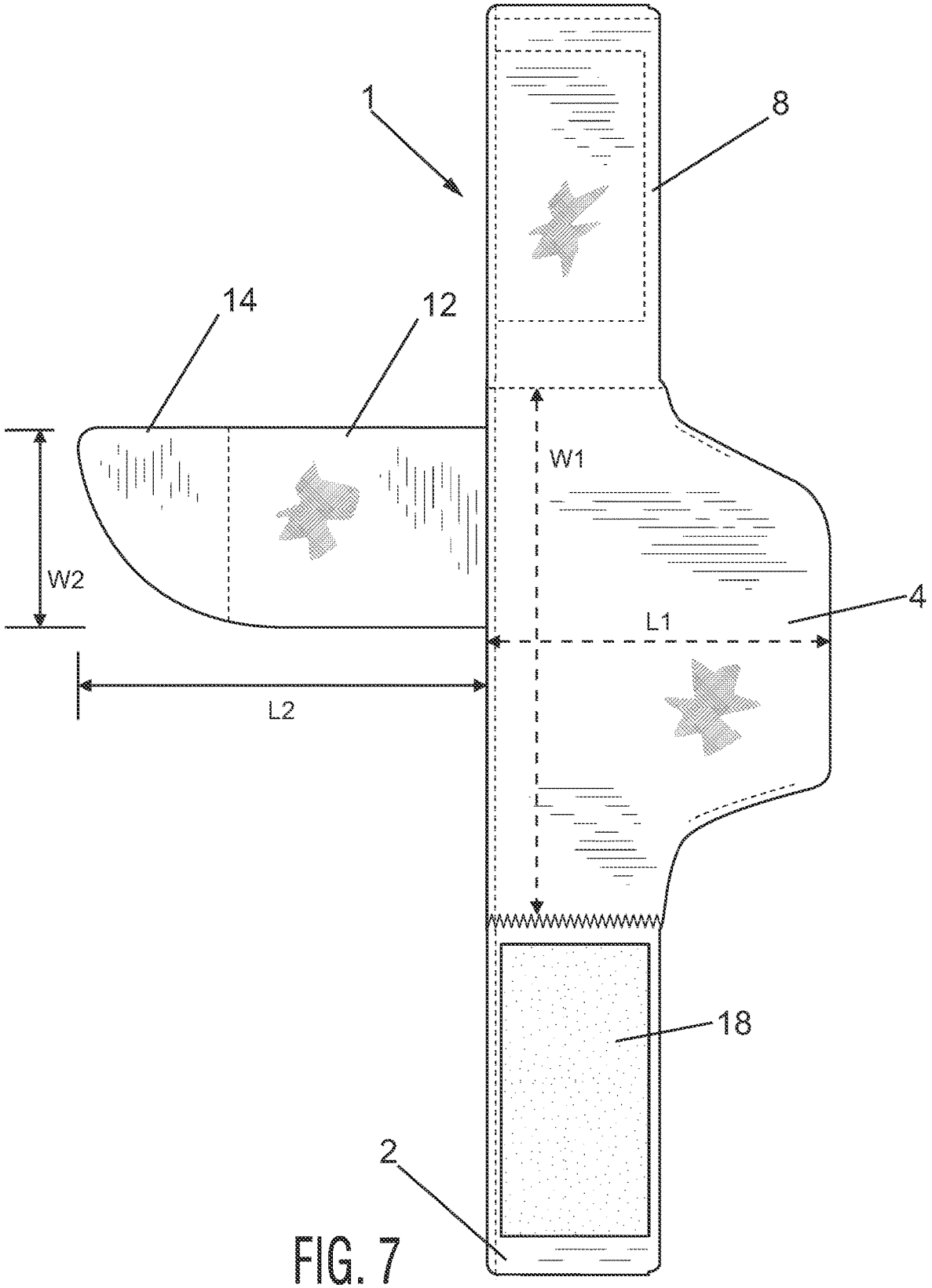
FIG. 7 is a bottom elevational view of the release holster apparatus of FIG. 1 in the first open state of FIG. 2.

FIG. 7 is a bottom elevational view of the release holster apparatus 1 of FIG. 1 in the first open state of FIG. 2.

Figure 8:
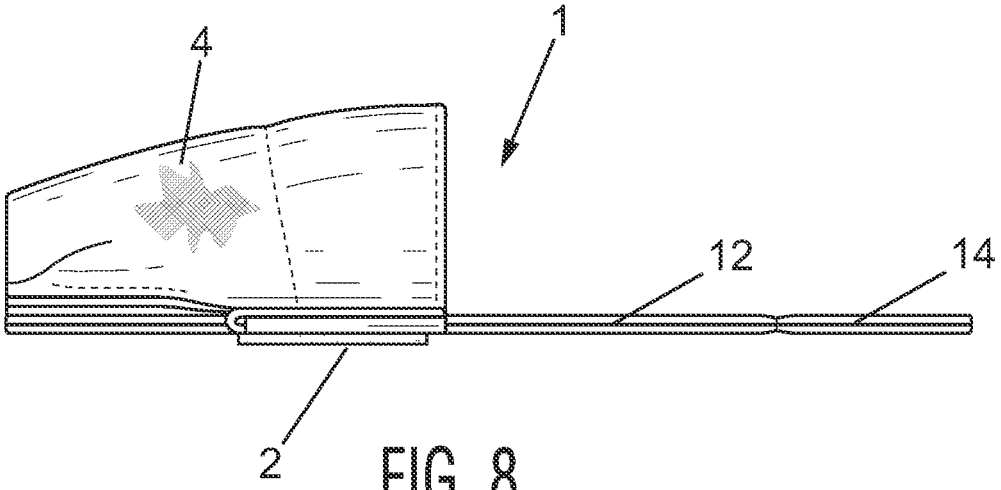
FIG. 8 is a front elevational view of the release holster apparatus of FIG. 1 in the first open state of FIG. 2.

FIG. 8 is a front elevational view of the release holster apparatus 1 of FIG. 1 in the first open state of FIG. 2.

Figure 9:
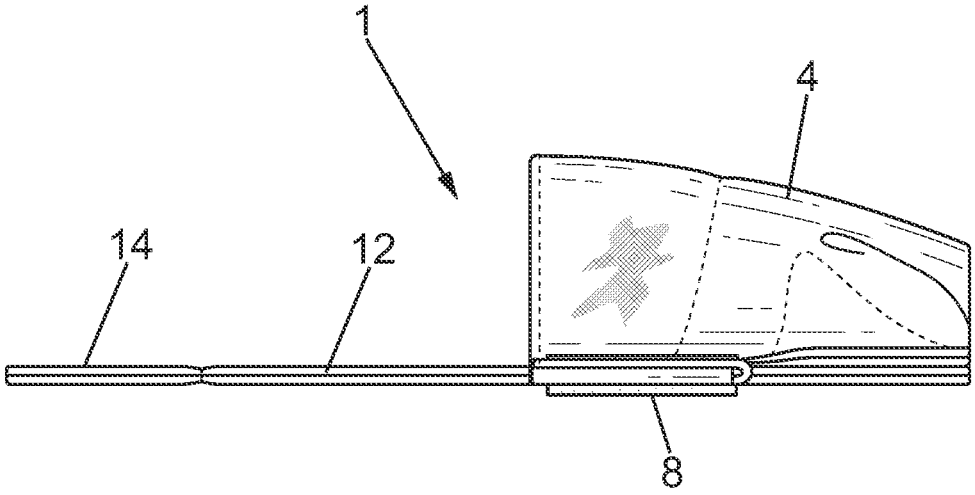
FIG. 9 is a rear elevational view of the release holster apparatus of FIG. 1 in the first open state of FIG. 2.

FIG. 9 is a rear elevational view of the release holster apparatus 1 of FIG. 1 in the first open state of FIG. 2.

Figure 10:
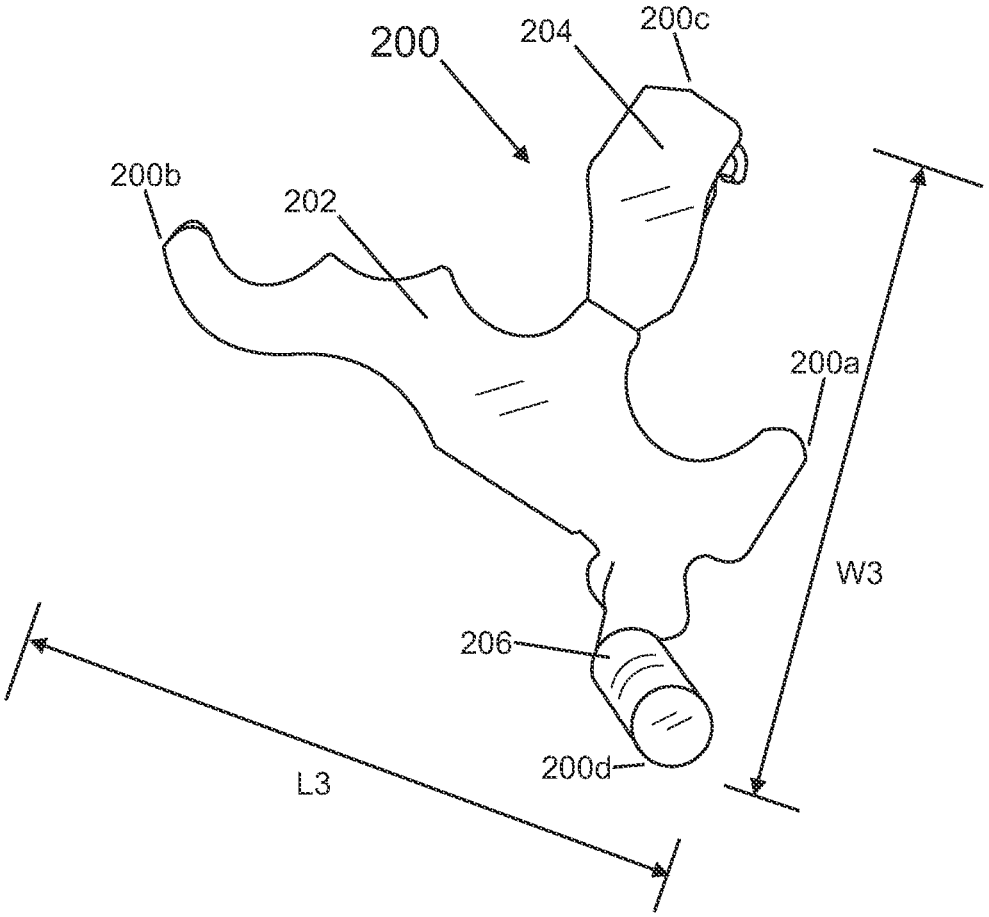
FIG. 10 is a simplified perspective view of one of many possible hand-held archery release aid designs with shared common features, for use in combination with the release holster shown in FIGS. 1-9.

FIG. 10 is a simplified perspective view of one of many possible hand-held archery release aid designs with shared common features, hand-held archery release aid 200, for use in combination with the release holster 1 shown in FIGS. 1-9.

Referring to FIGS. 1-9, the release holster apparatus 1 includes sections 2, 4, 6, 8, 12, and 14. The section 2 has a rectangular piece of an attachment device 18 attached to it as shown in FIG. 7. The attachment device 18 may be hooks and/or loops, such as Velcro (trademarked).

The section 8 has a rectangular piece of an attachment device 10 attached to it as shown in FIG. 6. The attachment device 10 may be hooks and/or loops, such as Velcro (trademarked), which is configured to attach and mate with the attachment device 18.

Each of the central section 4 and the central section 6 have peripheral edges that are attached together to form a pocket 5. The pocket 5 is open at the top and the bottom as shown by FIGS. 4 and 5.

There is a hook 16 shown in FIGS. 4 and 5 which is attached to the central section 6, within the pocket 5 and which is used as a secondary attachment point, by which a user can further secure the archery release aid to the release holster apparatus 1 by means of cordage or similar such material.

The flap, which includes sections 12 and 14 may be configured in the state of FIG. 2, in which the sections 12 and 14 are not attached to the central section 4, but only attached at an end of section 12 to central section 6. The flap (sections 12 and 14) may be configured in the state of FIG. 3, in which sections 12 and 14 are folded over the section 4 and attached to the section 4 by a magnet 7, which is sewn inside of and covered by a double layer of cloth of the section 4, so that magnet 7 cannot be seen. There is a magnetic or metal portion inside of a double layer of cloth of section 14, which cannot be seen, but which attached magnetically to the magnetic or metal section 7 within section 4, to thereby attach section 14 to section 4 as in FIG. 3.

In the configuration and state of FIG. 1, the sections 12 and 14 are attached to the section 4 (due to magnetic attraction and connection of sections 7 and magnet or metal within section 14, and the hooks and/or loops sections 10 and 18 are attached together to hold the apparatus 1 on a wrist 102 of a person.

In at least one embodiment, the release holster apparatus 1 is a unique, wearable device, configured particularly for the archery industry, to carry a hand-held archery release aid, such as release aid 200 shown in a simplified form, in FIG. 10, and shown with dashed lines in FIGS. 2 and 3. A release aid, such as release aid 200 is held at least partially within the pocket 5, safely attached to a human being's wrist, while offering a method by which to deploy the hand-held archery release aid 200 quickly for use.

The release holster apparatus 1 is configured as a stand-alone form of wearable storage specifically for a hand-held archery release aid that remains attached to the wrist by means of its integrated wrist strap and requires no additional point of attachment (e.g., pockets, bags, clips, belts, satchels, other binding materials, etc.). The pocket 5 of the release holster apparatus 1 is configured specifically to address the unique shape and style of the widest variety of hand-held archery release aids possible. The bottom of the pocket 5 is an open design allowing longer hand-held archery release aids to protrude unimpeded, while the top of the pocket 5 of the release holster apparatus 1 shown in FIG. 2, is designed with a magnetic closure (via sections 14 and 7) to ensure both smooth and silent operation of the retention flap (includes sections 12 and 14). The retention flap (includes sections 12 and 14) itself is off set to accommodate the activation barrel of most hand-held archery release aids.

The dimensions of the pocket 5 of the release holster apparatus 1 are configured to allow for smooth, convenient entry and egress of the hand-held archery release aid using one hand. In order to accommodate the disproportionate size of most hand-held archery release aids, the top 5*a* of the pocket 5 shown in FIG. 2 incorporates reinforced bolstering to maintain the form of the mouth of the pocket 5 even while under tension by the wrist strap, such as including sections 2, 8, and 6. The interior of the pocket 5 incorporates an integrated D-ring retention point or hook 16, shown in FIG. 4, to allow for optional attachment of a hand-held archery release aid to the release holster apparatus 1. Hook-and-loop material is used for attachment devices 18 and 10 to adjust in size, and is integrated with the pocket 5 with a streamlined, minimalist design that encourages weight savings while maintaining adequate resistance to twisting and sliding.

In at least one embodiment the release holster apparatus 1 is configured as a stand-alone form of wearable storage specifically for a hand-held archery release aid that remains attached to the wrist by means of its integrated wrist strap, which may include sections 2, 6, 8, 10, and 18, and requires no additional point of attachment (e.g., pockets, bags, clips, belts, satchels, other binding materials, etc.). The pocket and/or opening 5, formed by section 4 and section 6 of the release holster apparatus 1, in at least one embodiment is configured specifically to address the unique shape and style of the widest variety of hand-held archery release aids possible. The bottom shown in FIG. 5 of the pocket 5 is open, in at least one embodiment, allowing longer hand-held archery release aids to protrude unimpeded, while the top, shown in FIG. 4, of the release holster apparatus's pocket 5 is configured with a magnetic closure 7, shown in FIG. 2, to ensure both smooth and silent operation of a retention flap, which includes sections 12 and 14. The retention flap (sections 12 and 14) itself is off set to accommodate the activation barrel of most hand-held archery release aids, such as barrel or cylinder 206 of release aid 200, shown in FIG. 10 and shown in dashed lines in FIGS. 2 and 3.

The dimensions of the pocket 5 of the release holster apparatus is sized in at least one embodiment, to allow for smooth, convenient entry and egress of the hand-held archery release aid using one hand. The pocket 5 itself is configured with a tapered contour and open ends at the top 5*a* and the bottom 5*b* in order to accommodate the disproportionate and varying sizes, lengths, and dimensions of the many different types and styles of hand-held archery release aids available. The top, shown in FIG. 4, of the pocket 5 incorporates reinforced bolstering to maintain the form of the mouth of the pocket even while under tension by the wrist strap (includes sections 2, 6, 8, 10, and 18). In at least one embodiment, the interior of the pocket 5 incorporates the integrated D-ring 16 retention point to allow for optional attachment of the hand-held archery release aid to the release holster apparatus 1. The wrist strap (includes sections 2, 6, 8, 10, and 18) itself typically uses hook-and-loop material (for sections 10 and 18) to adjust in size, and is integrated into the pocket 5 with a streamlined, minimalist configuration that encourages weight savings while maintaining adequate resistance to twisting and sliding.

The tapered nature of the pocket 5 is shown by the larger opening at the top 5*a* as shown in FIG. 4 and the smaller opening at the bottom 5*b* as shown in FIG. 5.

The release aid 200 may be made entirely or substantially of solid metal, such as aluminum or steel. The release aid 200 may include sections 202 and 204, and barrel or cylinder 206. The barrel or cylinder 206 is fixed to the section 202, and protrudes outward at an angle substantially perpendicular to the section 202. The release aid 200 may have a width of W3, from an end 200*d* to an end 200*c*, and a length of L3, from an end 200*a* to an end 200*b*.

In at least one embodiment, the release holster apparatus 1 is configured so that the width W1 of the pocket 5 is at least as large as, or slightly larger than the width W3 of the release aid 200. The length L1 of the pocket 5 is preferably a substantial portion of the length L3 of the release aid 200, such as at least half of the length L3 of the release aid 200. A portion of the release aid 200 may protrude out the bottom 5*b*, and a portion may protrude out the top 5*a* of the pocket 5, when the release aid 200 is inserted as far as possible into the pocket 5 in FIG. 3 prior to the flap (sections 12 and 14) being closed. The flap (sections 12 and 14) is put into a closed state of FIG. 3 after the release aid 200 has been inserted as fair as possible, and the flap (sections 12 and 14) prevents the release aid 200 from being removed from the pocket 5. The barrel or cylinder 206 protrudes out from the top 5*a* of the pocket 5 to prevent the release aid 200 from sliding further into the pocket 5, and to provide a handle or section for a human being wearing the release holster apparatus 1, to grip to take the release aid 200 entirely out of the pocket 5, when the flap (sections 12 and 14) is disconnected from section 7 and put in an open state as in FIG. 2.

The sections 2, 6, and 8 together may be described as an elongated strap, having a length (in the direction of the width W1 of the pocket 5) which is substantially longer than the width (in the direction of the length L1 of the pocket 5), shown in FIG. 7.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. An apparatus comprising:

a release holster apparatus including:

an elongated strap;

a pocket formed between first and second sections of cloth material, and attached to the elongated strap; and a flap attached to the elongated strap;

wherein the pocket has a top opening and an opposing bottom opening;

wherein the flap has a first end attached nearer to the top opening of the pocket than the bottom opening of the pocket;

wherein the flap has a second end which opposes the first end of the flap;

wherein the flap is configured to be placed in an open state in which the flap does not cover any part of the top opening of the pocket; and wherein the flap is configured to be placed in a closed state in which the flap covers part of the top opening of the pocket, but not the entirety of the top opening of the pocket, and wherein a section of the flap is attached to a portion of the first section of cloth material of the pocket.

2. The apparatus of claim 1 further comprising hand-held archery release aid configured to fit at least partially in the pocket.

3. The apparatus of claim 2 wherein the elongated strap has first and second ends;

wherein the apparatus includes a first attachment device located nearer to the first end of the elongated strap than the second end of the elongated strap;

wherein the apparatus includes a second attachment device located nearer to the second end of the elongated strap than the first end of the elongated strap;

wherein the elongated strap is configured to wrap around a person's wrist with the first attachment device detachably attached to the second attachment device in order to hold the elongated strap, the pocket, the flap, and the hand-held archery release aid onto the person's wrist.

4. The apparatus of claim 1 wherein the first section of cloth material of the pocket is attached to the flap through a magnetic connection.

5. The apparatus of claim 1 wherein the elongated strap has first and second ends;

wherein the apparatus includes a first attachment device located nearer to the first end of the elongated strap than the second end of the elongated strap;

wherein the apparatus includes a second attachment device located nearer to the second end of the elongated strap than the first end of the elongated strap;

wherein the elongated strap is configured to wrap around a person's wrist with the first attachment device detachably attached to the second attachment device in order to hold the elongated strap, the pocket and the flap onto the person's wrist.

6. The apparatus of claim 1 wherein the pocket is configured to hold hand-held archery release aids of different sizes.

7. A method comprising:

attaching an elongated strap to the wrist of a person to attach a release holster apparatus to the wrist of the person;

wherein the release holster apparatus includes:

an elongated strap;

a pocket formed between first and second sections of cloth material, and attached to the elongated strap; and a flap attached to the elongated strap;

wherein the pocket has a top opening and an opposing bottom opening;

wherein the flap has a first end attached nearer to the top opening of the pocket than the bottom opening of the pocket;

wherein the flap has a second end which opposes the first end of the flap;

and further comprising placing the flap in an open state in which the flap does not cover any part of the top opening of the pocket; and placing the flap in a closed state in which a section of the flap is attached to a portion of the first section of cloth material of the pocket to thereby cover part of the top opening of the pocket, but not the entirety of the top opening of the pocket.

8. The method of claim 7 further comprising inserting a hand-held archery release aid at least partially into the pocket when the flap is in an open state.

9. The method of claim 8 wherein the elongated strap has first and second ends;

wherein the release holster apparatus includes a first attachment device located nearer to the first end of the elongated strap than the second end of the elongated strap;

wherein the release holster apparatus includes a second attachment device located nearer to the second end of the elongated strap than the first end of the elongated strap; and further comprising wrapping the elongated strap around the person's wrist with the first attachment device detachably attached to the second attachment device in order to attach the elongated strap, the pocket, the flap, and the hand-held archery release aid onto the person's wrist.

10. The method of claim 7 wherein the first section of cloth material of the pocket is attached to the section of the flap through a magnetic connection.

11. The method of claim 7 wherein the elongated strap has first and second ends;

wherein the release holster apparatus includes a first attachment device located nearer to the first end of the elongated strap than the second end of the elongated strap;

wherein the release holster apparatus includes a second attachment device located nearer to the second end of the elongated strap than the first end of the elongated strap; and further comprising wrapping the elongated strap around the person's wrist with the first attachment device detachably attached to the second attachment device in order to attach the elongated strap, the pocket and the flap onto the person's wrist.

12. The method of claim 7 wherein the pocket is configured to hold hand-held archery release aids of different sizes.

* * * * *